US008075214B2

(12) United States Patent
Walker

(10) Patent No.: US 8,075,214 B2
(45) Date of Patent: Dec. 13, 2011

(54) ELECTRIC PAINT TRAY APPARATUS

(75) Inventor: John A. Walker, Grand Junction, CO (US)

(73) Assignee: Lets Roll, LLC, Grand Junction, CO (US)

( * ) Notice: Subject to any disclaimer, the term of this patent is extended or adjusted under 35 U.S.C. 154(b) by 876 days.

(21) Appl. No.: 12/110,476

(22) Filed: Apr. 28, 2008

(65) Prior Publication Data

US 2009/0269123 A1 Oct. 29, 2009

(51) Int. Cl.
*B05C 11/00* (2006.01)
*B05C 11/02* (2006.01)
*B44D 3/12* (2006.01)

(52) U.S. Cl. ..... 401/208; 15/257.06

(58) Field of Classification Search ..... 401/208, 401/219, 191; 15/257.06, 257.05; 134/900
See application file for complete search history.

(56) References Cited

U.S. PATENT DOCUMENTS

| | | | | |
|---|---|---|---|---|
| 2,982,984 | A * | 5/1961 | Discipio | 401/208 |
| 4,175,300 | A | 11/1979 | McGlew et al. | |
| 4,537,522 | A | 8/1985 | Charney et al. | |
| 4,576,553 | A | 3/1986 | Winston et al. | |
| 4,639,156 | A | 1/1987 | Stern et al. | |
| 4,842,432 | A | 6/1989 | Snetting | |
| 4,941,229 | A * | 7/1990 | La Pierre | 15/257.06 |
| 5,454,656 | A | 10/1995 | Rowe | |

* cited by examiner

*Primary Examiner* — David J. Walczak
*Assistant Examiner* — Bradley Oliver

(57) ABSTRACT

Liquids in general, and paint in particular, can be evenly distributed by a paint transfer drum having a friction-creating surface that is placed in contact with a friction-receiving surface of an endless belt that is driven (by the drum as it rotates) into and out of a container for the liquid. A scraper removes a portion of the lifted liquid from the endless belt. The scraped liquid falls upon a liquid distribution device that serves to evenly distribute said liquid laterally so that it will be evenly applied along the exterior surface of the paint transfer drum.

30 Claims, 13 Drawing Sheets

ELECTRIC PAINT TRAY APPARATUS

BACKGROUND OF THE INVENTION

1. Field of the Invention

This invention generally relates to hand held, roller-type paint applicators. More particularly, it relates to electrically powered devices for applying paint to such hand held, roller-type paint applicators.

2. Discussion of the Background

Many hand held paint applicators (short-handled as well as long-handled) have a paint roller component whose interior cavity is supplied with paint that is placed under pressure by an electrically powered pump. U.S. Pat. Nos. 4,175,300; 4,576,553; 4,639,156; 4,842,432 and 5,454,656 teach a variety of such paint applicators. U.S. Pat. No. 4,537,522 ("the '522 patent") is of particular interest to this patent disclosure because it teaches an electrically powered paint applicator having both a paint applicator roller and a paint feed roller that are placed in rolling contact with each other. An inside cavity of the paint feed roller is filled with paint that is placed under pressure in order to force the paint through the paint-porous body of the paint feed roller and on to its outside surface. The paint ladened outside surface of the paint feed roller is placed in rolling contact with the paint applicator roller. This arrangement results in paint being transferred from the outside surface of the paint feed roller to the outside surface of the paint applicator roller. The paint applicator roller is then placed in rolling contact with a surface (such as a wall) that is to be painted.

Unfortunately, pressurized paint rollers have been plagued with several persistent drawbacks. Not the least of these follows from the fact that their paint pressurizing pumps must create fluid pressures great enough to force paint through their porous paint roller bodies, or through an array of small holes in those roller bodies. Such pressures often cause the roller's paint seals to leak. This leakage generally causes unsightly paint applications as well as messy conditions that cause a great deal of extra cleanup work. Moreover, these pressurized rollers do not always evenly supply paint to the outside surface of the pressurized rollers even when their paint seals do not leak. This uneven paint application on to a roller's outside surface often results in blotchy and otherwise unsightly paint applications. Pressurized paint applicators are also difficult to take apart and put together for cleaning and maintenance operations. Moreover, pressurized paint rollers are rather expensive compared to hand powered, non-pressurized paint rollers.

Consequently, many painters—professional as well as amateur—prefer to use hand powered roller devices whose paint applicator rollers are not pressurized, but rather are re-supplied with paint simply by rolling them in an open tray of paint. These paint trays usually have a lower paint reservoir portion and a higher, inclined plane portion. There are, however, several drawbacks associated with hand powered paint rollers vis-à-vis their working relationships with paint trays. Not the least of these is the fact that the weight of the paint on a bottom semicircular portion of a paint roller that has been dipped in a paint tray reservoir will cause that roller to rotate such that the paint ladened portion of the roller will, under the influence of gravity, go to its lowermost rotative position. The problem then becomes how to apply paint to the top semicircular portion of the roller that has not yet been dipped into the paint. Immersing the entire roller in the tray's paint reservoir is not a good technique because such immersion will cause too much paint to be placed on the roller, and worse yet on the paint roller's mounting arm—from which paint will profusely drip on to the floor next to a wall or other building component that is being painted.

As an alternative method of getting paint on the entire circumference of the paint roller, many painters will simply roll the half immersed paint roller up the inclined plane portion of a paint tray in order to more evenly distribute the available paint about the entire circumference of the paint roller. However, by the time the paint on the lower half of the roller is more evenly distributed about the entire circumference of the paint roller, an excessive amount of the paint is often squeezed from the roller and, hence, is not available for application to the surface being painted (e.g., a room wall).

Consequently, one of the most commonly used techniques to apply paint to an undipped portion of a paint roller is to rotate the roller 180 degrees—by hand. The hand powered 180 degree rotation of the roller is tedious and messy. Nonetheless, it must be carefully done in order to prevent blotchy looking paint applications. That is to say that the paint-free semicircular side of the roller must be rotated by hand and submerged into the paint reservoir in the open paint tray. Thus, it is only after two dips and one hand powered rotation of the roller that there will be an appropriate amount of paint covering both semicircular sides of the paint roller. At this point most painters simply begin to back the paint roller up the paint tray's inclined plane portion in order to more evenly spread an appropriate amount of the paint on the entire circumference of the roller. After 8-10 seconds of such paint evening action, the roller is usually ready to transfer its evened paint supply onto a wall, etc. that is being painted.

The electric paint tray of this patent disclosure, among other things, obviates the need for the 180 degree hand powered rotation of the paint roller. It also rotates the roller component of the hand held paint applicator in a manner that more evenly spreads an appropriate amount of the paint over the entire circumference of said roller component. It also greatly reduces the frequency of the painter's need to kneel or bend over a paint tray.

SUMMARY OF THE INVENTION

The electric paint tray apparatus of this patent disclosure will often be referred to simply as an "electric paint tray." Regardless of nomenclature, the electric paint trays of this patent disclosure will generally comprise: (1) a paint transfer drum that is journaled in a housing and wherein said paint transfer drum further comprises at least one friction-creating surface (e.g., a knurled surface, a gear teeth array or the like) on said drum's exterior surface, (2) a housing in which the paint transfer drum is journaled, (3) at least one endless belt whose inside surface is provided with another friction-receiving surface that engages with the friction-creating surface (e.g., a knurled surface, a gear teeth array or the like) on the exterior surface of the paint transfer drum, (4) a scraper for removing paint from the endless belt, (5) a paint distribution device for evenly distributing paint over the length of the exterior surface of the paint transfer drum and (6) an electrically powered motor for driving the paint transfer drum in a rotary manner. The paint transfer drum is intended to be placed in rolling contact with an independent (i.e., not a component of the present invention), hand powered paint roller device that usually will have a handle from about eighteen inches in length to about eight feet in length.

Generally speaking, the paint transfer drums of this patent disclosure will better dispense paint on to the roller component of such an independent, hand powered paint roller device when the length of the paint transfer drum (and especially the length of its paint distribution surface) is greater than the axial length of the roller component of the independent, hand powered paint roller device. Such paint transfer drums may also be designated in this patent disclosure as "elongated," paint transfer drums. In any case, Applicant has found that better results are usually achieved when the paint distribution device of Applicant's electric paint tray is also of an "elongated" nature (i.e., wherein the paint distribution device is also longer than the roller component of the independent, hand powered paint roller). Since most commonly available roller components of hand held paint applicators (be they hand powered or motor powered) are either nine inches or twelve inches in length, an elongated, paint transfer drum somewhat longer than twelve inches (e.g., up to about eighteen inches) will generally be able to service both of these standard sized paint roller components.

Next it should be noted that Applicant's endless belt, and especially its exterior surface, should be made of a material to which a liquid (e.g., paint) can adhere well enough to be lifted to the scraper unit. The exterior surfaces of other endless belts may be made of materials that are capable of readily absorbing and desorbing the liquid being raised by this apparatus. Such liquid absorbing/desorbing materials (e.g., cotton based, woven fabric materials or molded polymeric materials) will generally be characterized by their finely divided or microporous structures that present large surface active areas that are conducive to absorbing/desorbing a liquid. Finally, it should be emphasized here that, for the purposes of this patent disclosure, Applicant has used, and will use, the term "paint" to describe the subject liquid, but it should be clearly understood that Applicant's use of the term "paint" should include other liquids such as stains, shellacs, varnishes, wood preservatives and the like that are commonly applied by use of independent, roller devices such as the roller device 12 depicted in FIG. 1.

DETAILED DESCRIPTION OF THE INVENTION

Figure 1:
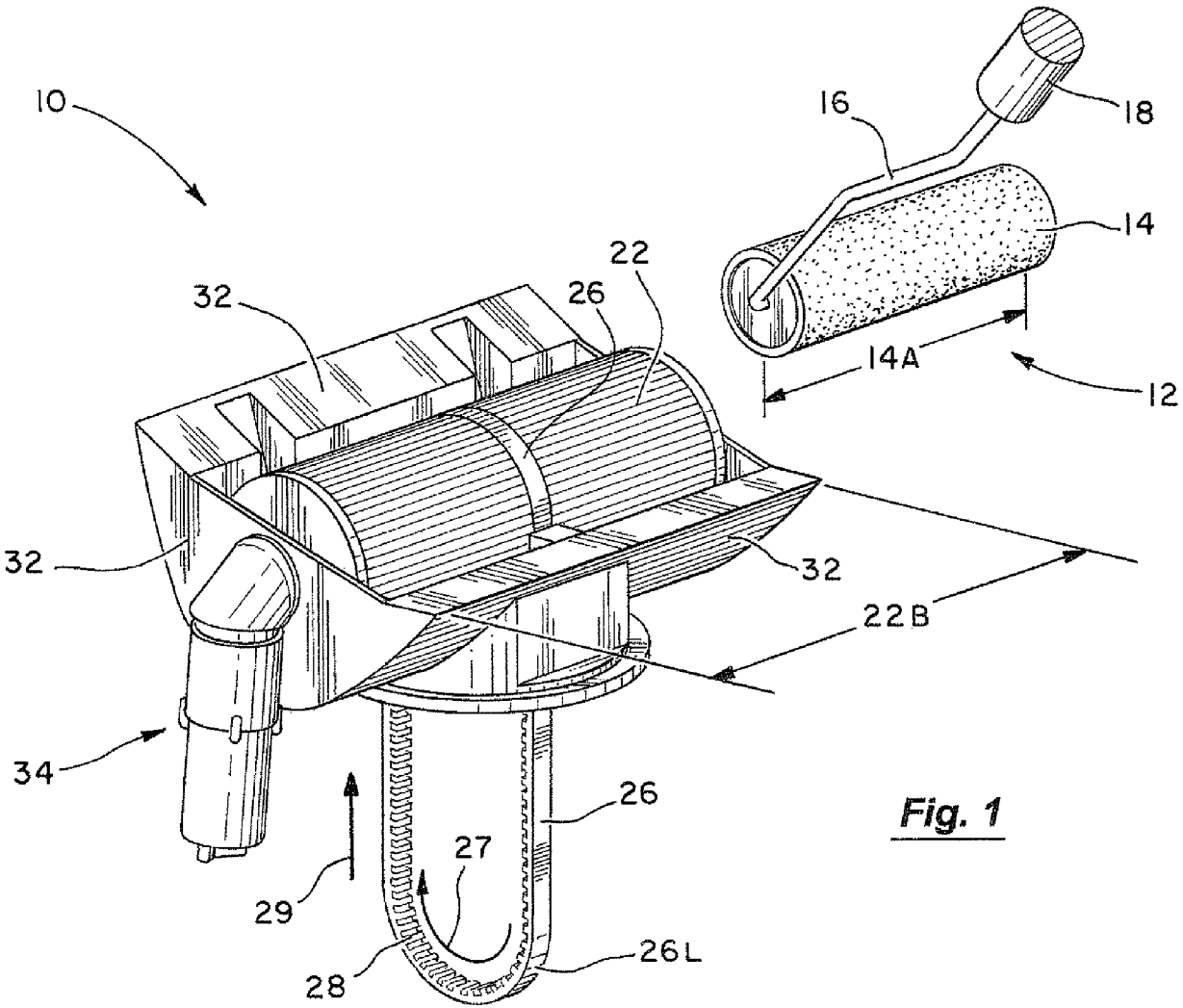
FIG. 1 is a perspective view of some of the main components of Applicant's electric paint tray apparatus. A simple (i.e., non-pressurized and hand powered) independent, long handled paint roller is also shown in this figure.

FIG. 1 is a perspective view of some of the more important components of the electric paint tray apparatus 10 of this patent disclosure. These components are shown along with an independent, hand powered, long handled paint roller device 12 that does not constitute an integral part of Applicant's invention. Hence Applicant will use the term "independent" in many of the descriptions of such paint roller devices. And as previously noted, such a paint roller device 12 could just as well be provided with a much shorter handle (e.g., one about 12 to about 24 inches long). In any case, such an independent, hand powered paint roller device 12 will generally comprise a cylindrically shaped paint absorbing/desorbing roller 14, a paint roller mounting arm 16 and a handle 18. Applicant's electric paint tray is also used in conjunction with a liquid container (such as the paint can designated as item 20 in FIG. 2) that likewise does not constitute an integral part of this invention.

The more important components of Applicant's electric paint tray 10 shown in FIG. 1 include: (1) a cylindrically shaped, rotary powered, paint transfer drum 22 (and especially an elongated, rotary powered, paint transfer drum 22) having at least one friction-creating surface such as a gear teeth array or a knurled surface on its exterior surface (e.g., such a friction-creating surface is shown in the form of a gear teeth array 24 in FIG. 4), (2) an endless belt 26 whose inside surface is provided with a friction-receiving surface (e.g., a gear teeth array 28) that cooperatively engages with the friction-creating surface (e.g., a gear teeth array 24) on the exterior surface of the rotary powered, paint transfer drum 22, (3) a powered axle 30 (see for example, item 30B of FIG. 3 wherein a portion of this powered axle 30 is shown: (a) journaled in a housing 32, and (b) provided with a device (e.g., a cotter key) for affixing said powered axle 30 to the rotary powered, paint transfer drum 22, and (4) an electric motor 34 for powering the axle 30 which is used in conjunction with well known mechanical connection devices (not shown). The motor 34 can be battery powered or powered by electricity obtained from a common 120 volt electrical power outlet.

The lower looped portion 26L of the endless belt 26 depicted in FIG. 1 is shown being driven in a generally clockwise direction 27. The left side of the endless belt 26 can be thought of as being ladened with paint by virtue of having been immersed in a can of paint and being raised upwardly as generally suggested by direction arrow 29. Liquids such as paint will simply adhere to a wide variety of belt materials (e.g., polymers, steel, leather, etc.) well enough to be lifted to the liquid scraper device of this patent application. Other endless belts of this patent disclosure can be made of a material rigid and strong enough to withstand the constant engagement and disengagement of its gear teeth 28 (or other friction-receiving surface) with the gear teeth 24 (or knurled surface) of the rotary powered paint transfer drum 22 and yet porous enough to absorb and desorb the subject liquid. It should also be noted that the endless belt may be made of several layers or plys of material that are bonded together. For example, an under layer may be made of a tough but flexible polymeric material conducive to the creation of gear teeth (or knurled surface) while an over layer may be made of a softer porous material that is suited to absorbing and desorbing a particular liquid (e.g., a water-based latex paint).

FIG. 1 also suggests that the independent, paint roller device 12 is about to be placed in rolling contact with the rotary powered, paint transfer drum 22 of this patent disclosure. The length 14A the paint roller 14 of the independent, paint roller device 12 will normally be from about 9 inches to about 12 inches since most commonly available paint rollers have standardized lengths of 9 inches or 12 inches. Generally speaking, the length 22B of the elongated rotary powered, paint transfer drum 22 will be greater than the length 14A of the paint roller 14 being employed. Again, Applicants use of the expression "elongated" (e.g., as in "elongated, rotary powered, paint transfer drum" or "elongated paint distribution piece") can generally be taken to mean that the length 22B of the elongated, rotary powered, paint transfer drum 22 (or elongated paint distribution piece) is greater than the length 14A of the roller 14 of the paint roller device 12. This circumstance is not, however, a necessary condition for the operation and use of the hereindisclosed invention. That is to say that the length 14A of the roller 14 of the independent, paint roller 12 could be greater than the length 22B of the elongated, rotary powered, paint transfer drum 22, but Applicant has found that more effective paint applications will generally be attained (especially by nonprofessional painters) if the length 22B of the elongated, rotary powered, paint transfer drum 22 is greater than the length 14A of the roller 14.

Figure 2:
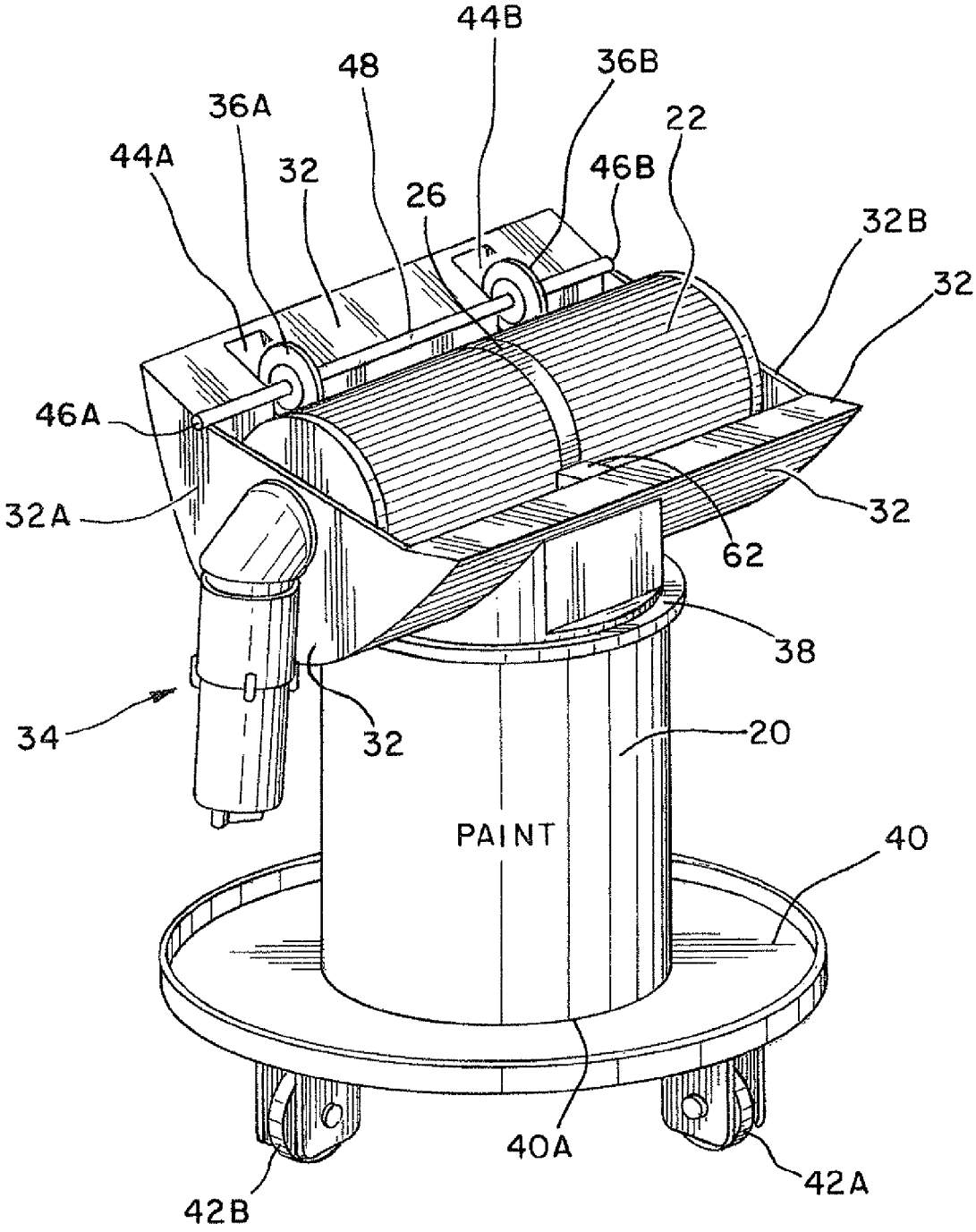
FIG. 2 is a perspective view of the electric paint tray apparatus of FIG. 1 shown in association with an open can of paint that is depicted as being covered by the electric paint tray apparatus and resting upon a wheeled base.

FIG. 2 shows the more important components of the electric paint tray 10 depicted in FIG. 1 mounted on top of an open can of paint 20. For example, a lower rim 38 of the housing 32 may be mounted to the channel commonly found in the upper rim of paint cans that normally receive a nub portion of a paint can lid in order to tightly seal such paint cans. This particular paint can 20 is, by way of example only, also shown resting on a base 40. This base 40 can be provided with a cavity 40A in which the bottom of the paint can 20 reside in order to better stabilize said can 20. This base 40 is also shown provided with a wheel system 42A, 42B, etc. on its underside. FIG. 2 also shows the housing 32 further comprising two paint roller abutment wheels 36A and 36B that respectively reside in cavities 44A and 44B in the housing 32. These paint roller abutment wheels should, however, be regarded as auxiliary items to Applicant's more fundamental invention. These paint roller abutment wheels 36A and 36B can, for example, be mounted on an axle 48 that is journaled at points 46A and 46B on the respective ends 32A and 32B of the housing 32. As will be seen in FIGS. 3 and 8, the powered axle 30 of the rotary powered, paint transfer drum 22 can likewise be journaled in the respective ends 32A and 32B of the housing 32.

Figure 3:
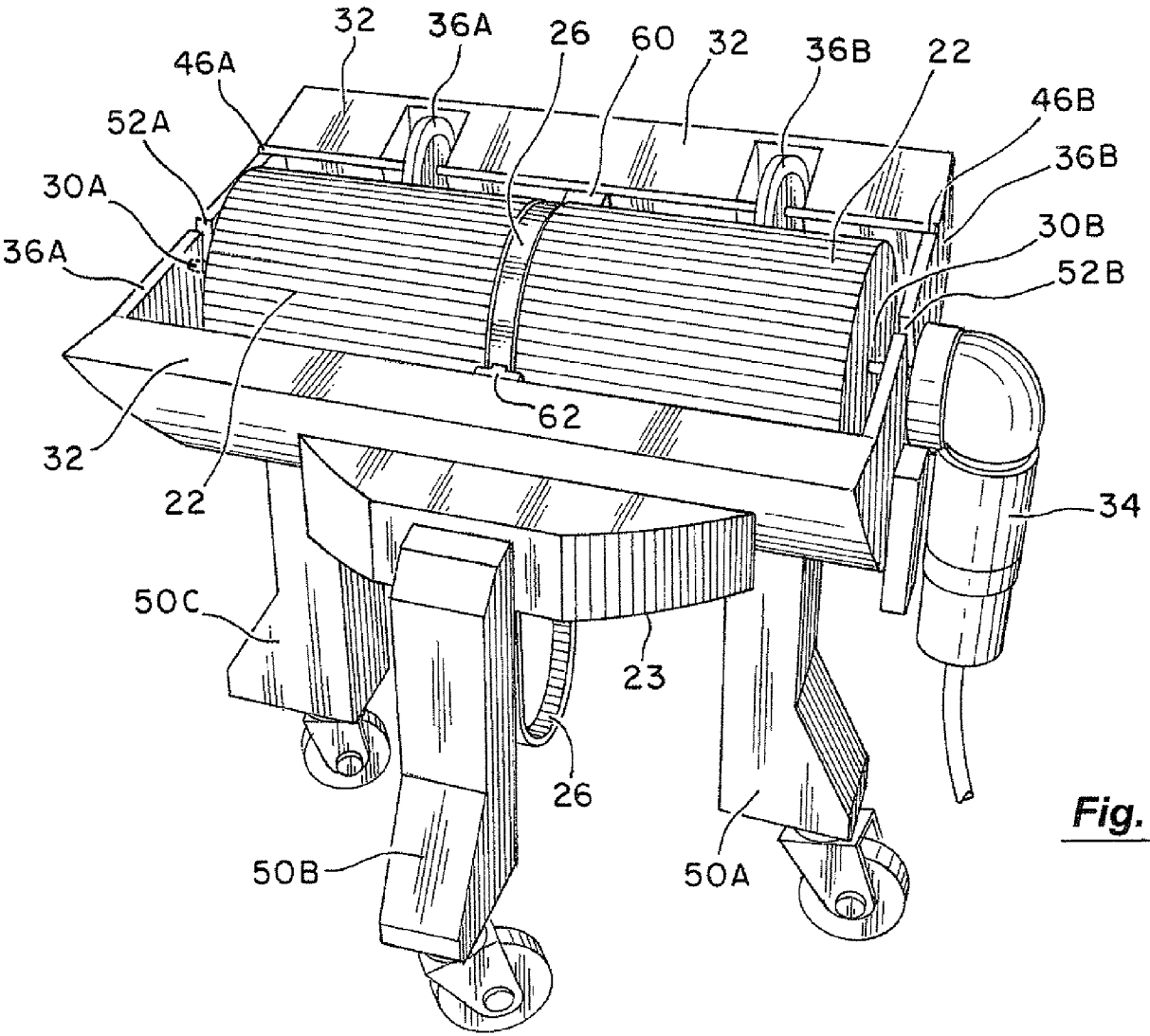
FIG. 3 is a perspective view of a representative electric paint tray of this patent disclosure shown further provided with wheeled legs.

FIG. 3 depicts another embodiment of this invention wherein the housing 32 is mounted on legs (e.g., legs 50A, 50B, 50C, etc.) that are, by way of example only, shown provided with wheels. FIG. 3 also depicts the powered axle 30 (whose right end is labeled 30B) mounted in a right journal opening 52B. Similarly the left end (30A) of the powered axle 30 is journaled in a left journal opening 52A. These journal openings 52A and 52B are open at the top so that the entire axle 30 (and hence the rotary powered drum 22 attached to it) can be lifted vertically and then completely removed from the housing 32. This capability facilitates mounting the endless belt 26 to the rotary powered, paint transfer drum 22 during initial assembly of the electric paint tray 10, as well as subsequent cleaning, maintenance and/or repair of said drum 22. This mounting arrangement will also facilitate placement of various sleeves (hereinafter more fully described in the discussion of FIG. 11) on the rotary powered, paint transfer drum 22. FIG. 3 also suggests the presence of a rim 23 on the outside bottom of the housing that fits into an underlying container and thereby assuring that any falling paint will be directed back into the underlying, open paint container.

Figure 4:
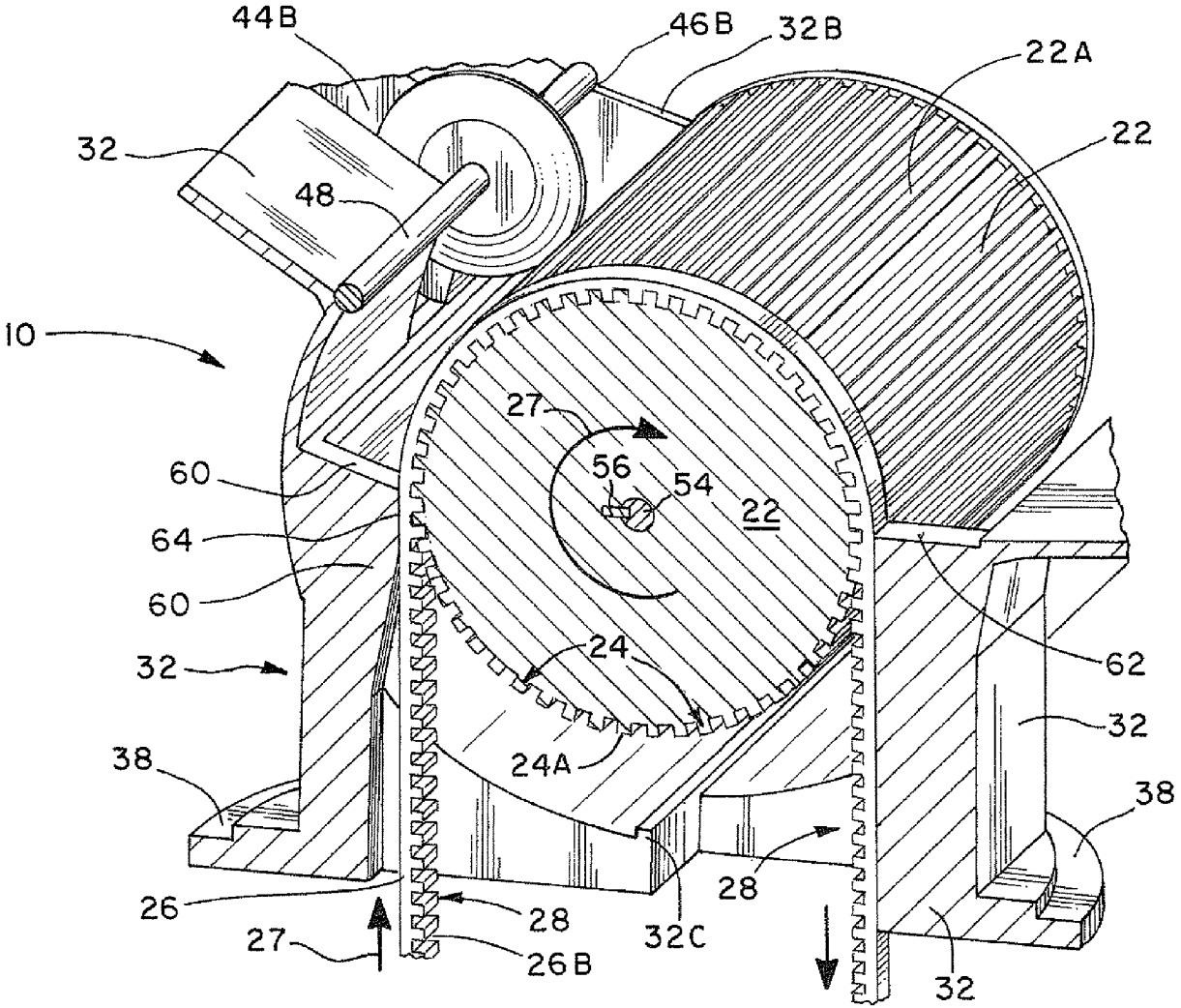
FIG. 4 is a perspective cut-away view of Applicant's electric paint tray that shows a friction-creating surface in the form of a gear teeth array on the inside of the endless belt engaging with (and disengaging from) a gear teeth array on an exterior portion of Applicant's paint transfer drum.

FIG. 4 is a perspective cut-away view of Applicant's electric paint tray 10 that particularly emphasizes an embodiment of this invention wherein the engagement of a gear teeth array 24 of the rotary powered, paint transfer drum 22 with a gear teeth array 28 of the endless belt 26 as the means of attaining a friction-creating/friction-receiving relationship between the drum and the belt. It might also be noted here that both the endless belt and the gear teeth array of the paint transfer roller 22 shown here may be chamfered so that the endless belt 26 can be held in better cooperative contact with the drum's gear teeth. These chamfered configurations are better illustrated in FIG. 12B along with belt sides (and gear teeth array sides) that are linear (see FIG. 12A). Be that as it may, the present cross section view of the rotary powered, paint transfer drum 22 also shows a center hole 54 through which axle 30 (see for example item 30B of FIG. 3) passes. Such an axle 30 must tightly engage with the drum 22 and thereby providing the method by which the powered axle 30 drives the drum 22 in its powered rotation. By way of example only, a cotter key 56 can be used for this purpose. This paint transfer drum 22 is also shown being driven in a clockwise direction suggested by direction arrow 27. FIG. 4 also illustrates that the exterior surface of the rotary powered, paint transfer drum 22 may have a rough surface 22A that facilitates the adsorbtion of the paint (or other liquid) that is applied to that rough surface 22A. Again, this rough surface 22A may also be supplied by a sleeve component (see, for example, FIG. 11) having a rough paint-absorbing exterior surface and which is also capable of being tightly fitted on to the exterior surface of a rotary powered drum. Such sleeves will generally be replacement or throw-away items that facilitate the care and cleaning of the electric paint tray 10.

Figure 5:
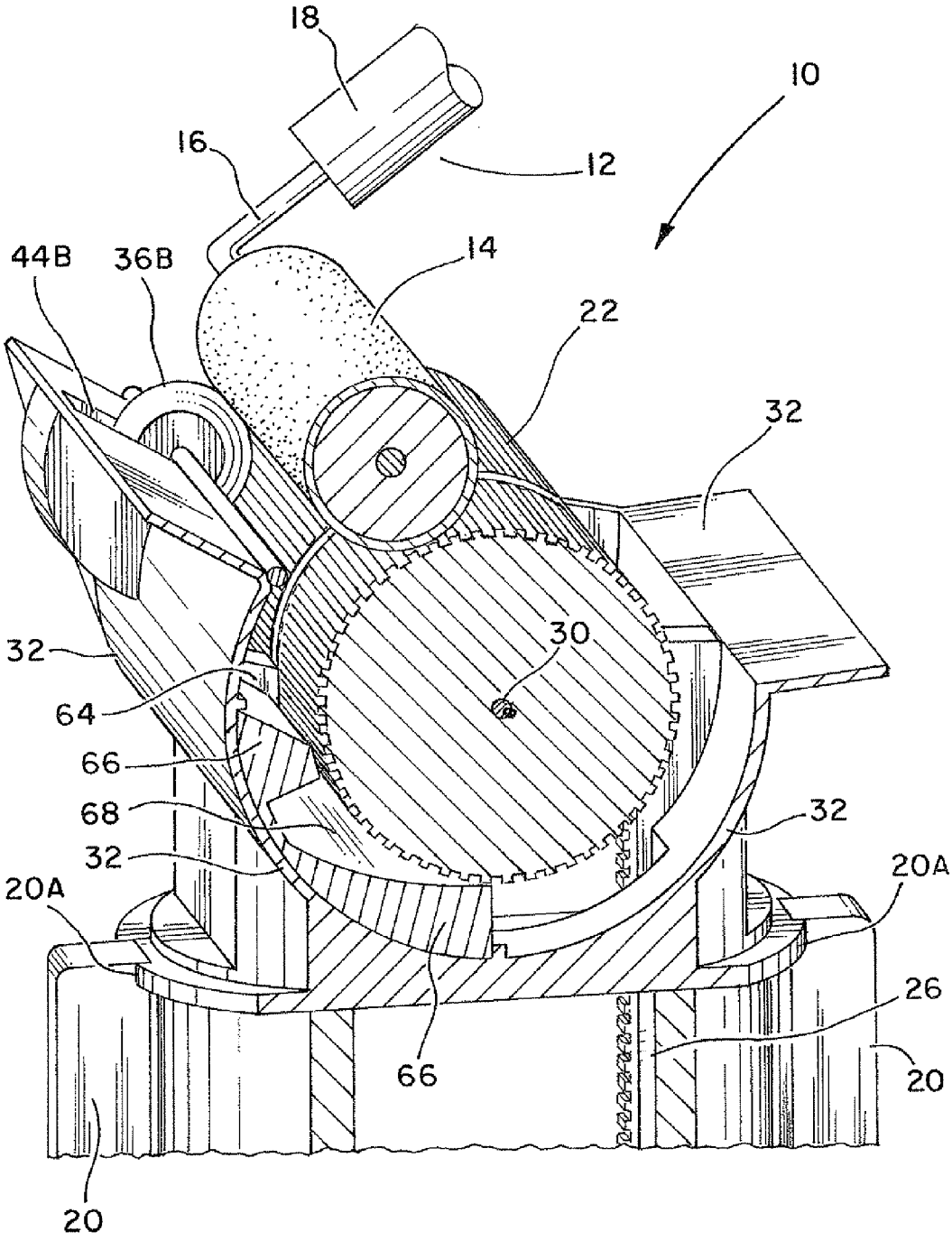
FIG. 5 is a perspective cut-away view of Applicant's apparatus that shows the presence and configuration of a representative paint distribution device. It also shows a hand held paint transfer roller device being held in rolling contact with the paint distribution device by an abutment roller.

FIG. 5 is a cut-away perspective view of the electric paint tray 10 of this patent disclosure. The cut-away aspect of this view particularly shows the presence of, and physical shape of, a representative paint distribution device 66. Such a paint distribution device 66 may be a removable component that can be mounted in the housing 32, or it may be made a permanent part of said housing. A paint scraping device 64 is also visible in this cut-away view. Such a paint scraping device 64 can also serve to hold the belt 22 against the paint transfer drum 22 in the ways suggested in FIGS. 12A and 12B. FIG. 5 also suggests: (1) the electric paint tray 10 mounted to the rim 20A of a paint can 20, (2) the paint roller 14 of an independent, hand powered paint roller device 12 in rolling contact with the rotary powered drum 22 and (3) the paint roller 14 being held in rolling contact with a paint roller abutment wheel 36B. The paint roller abutment wheel 36B (especially in conjunction with another paint roller abutment wheel 36A) serves to prevent the paint roller 14 from being completely driven off the rotary powered, paint transfer drum 22 when the paint roller 14 is first placed in contact with a rotating paint transfer drum 22.

Figure 6:
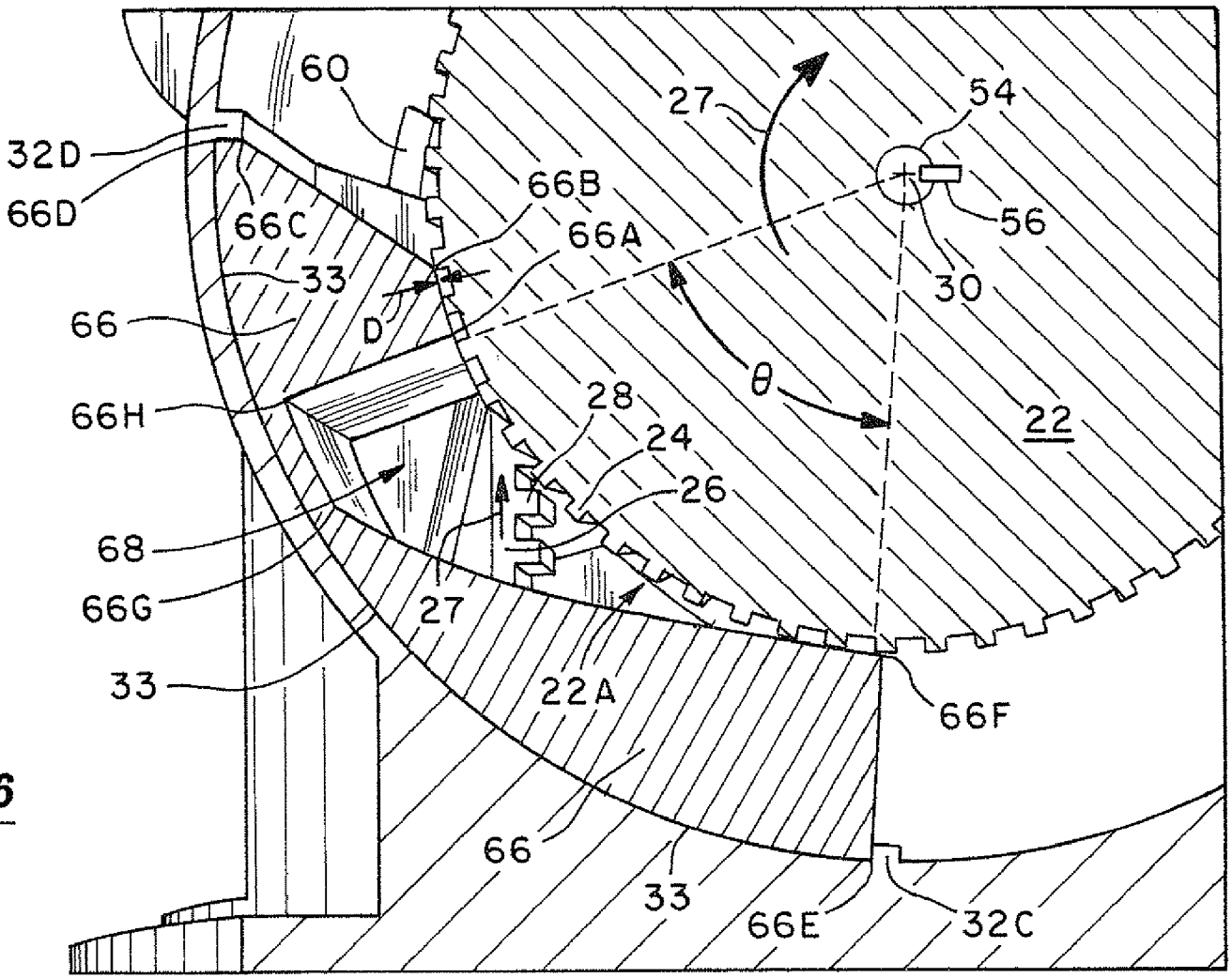
FIG. 6 is an enlarged, cross sectional view that shows the general configuration of a paint distribution device and its mode of cooperation with a paint transfer drum.

FIG. 6 is an enlarged, cut-away, perspective view of Applicant's electric paint tray 10. It particularly emphasizes the location, shape and function of the paint distribution device 66. For example, as seen in this view, the paint distribution device 66 is generally located in the lower left quadrant of the housing's interior cavity region 33. The outline of this paint distribution device 66 is generally designated by points 66A, 66B, 66C, 66D, 66E, 66F, 66G, 66H and back to 66A. FIG. 6 also shows how a paint reservoir cavity 68 is created between the outside surface 22A of the rotary powered paint transfer drum 22 (this paint reservoir cavity 68 is also shown as generally existing over the arc angle θ) and an inside surface portion of the paint distribution device 66 that is defined by points 66A, 66H, 66G, 66F and back to 66A. It might also be noted here that any raised regions of excess paint on the drum surface 22A created by its rolling action with a paint roller 14 will be scraped away from the surface of the paint transfer drum 22 at point 66F.

The paint reservoir cavity 68 is the means by which the electric paint tray receives and accumulates the paint lifted from the paint can 20 to the paint belt scraper 64 (not visible in FIG. 6). Upon being so lifted and scraped, the paint is laterally distributed (see direction arrows 72 and 74 of FIG. 7) over the length of the paint distribution device 66, and hence over the lateral length of the paint reservoir cavity 68 of this electric paint tray apparatus 10. In this depiction, the paint in the paint reservoir cavity 68 can be thought of as being absorbed on to that portion of the rotary powered drum's exterior surface 22A over the arc angle θ, or between the points 66F and 66A of the paint distribution device 66. Any excess paint placed on the rotary powered, paint transfer drum's exterior surface 22A during its pass through angle θ is removed when that portion of the drum's surface passes by the surface of the paint distribution device 66 that exists between points 66A and 66B. The distance between the surface of the paint distribution device 66 between its points 66A and 66B and the exterior surface 22A of the paint distribution drum 66 is designated by item "D" in FIG. 6 and will generally be from about one thousandths of an inch to about 125 thousandths of an inch. The net effect of this passage between points 66A and 66B is that the paint will be placed in an evenly distributed state on the paint transfer drum's outer surface 22A once it passes above point 66B. This even, lateral distribution of paint on the paint transfer drum's outer surface 22A facilitates an even distribution of paint on to the outer surface of the roller 14 of an independent, hand powered paint roller device 12. It might also be noted here that, if this paint distribution device 66 is a detachable component of the electric paint tray 10, it can be readily mounted in the interior cavity region 33 of the electric paint tray's housing 32 by means of end stops such as those suggested by items 32C and 32D of FIG. 6.

Figure 7:
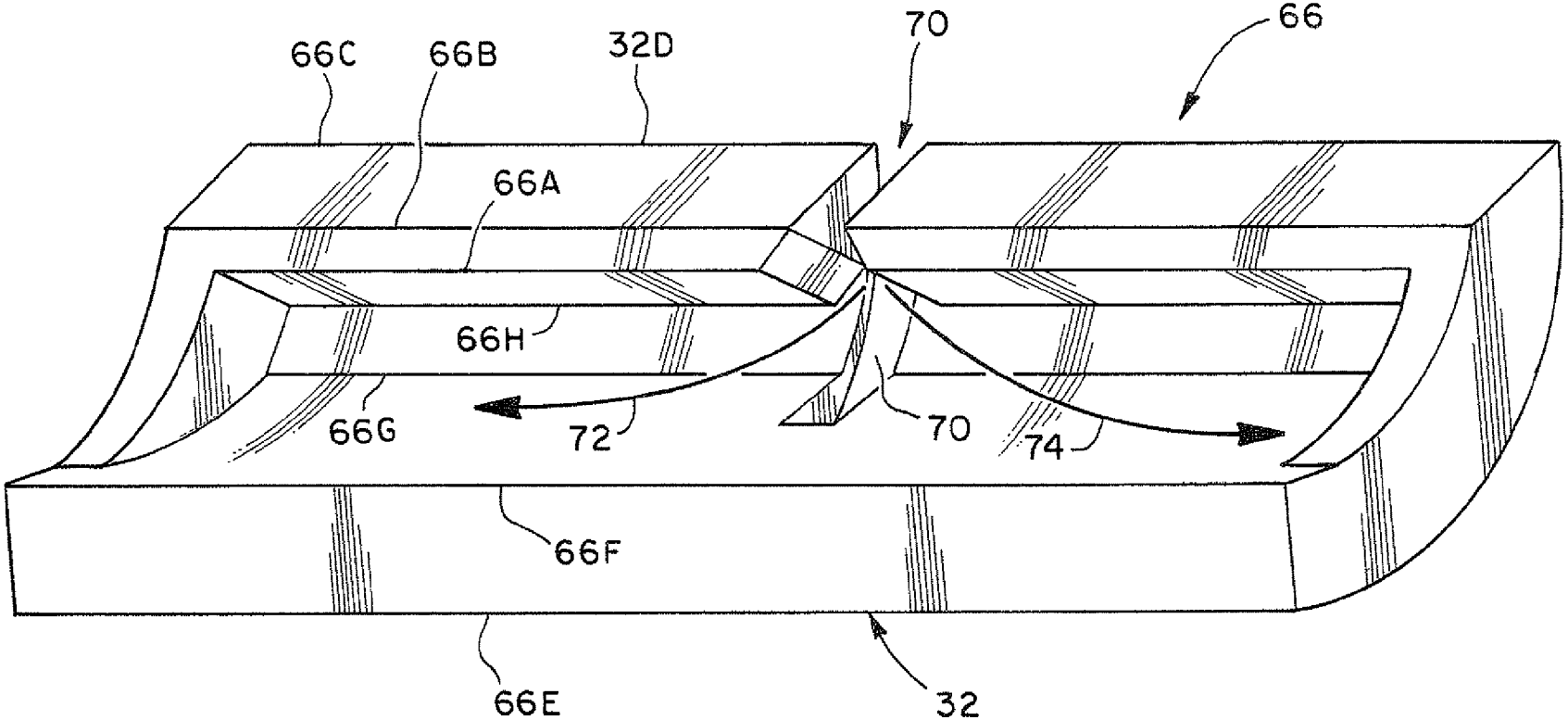
FIG. 7 is a front perspective view of a representative paint distribution device suitable for use in the electric paint trays of this patent disclosure.

FIG. 7 is a perspective view of the paint distribution device 66 discussed with respect to FIG. 6. It also depicts the location and shape of a slot 70 through which the endless belt 26 (not shown) passes. Direction arrows 72 and 74 generally depict the lateral distribution of the paint after it is scraped off the endless belt (e.g., by the belt scraper area 64A of the combined belt scraper 64 and front drum support 60 component shown in FIG. 8). It might also be noted here that the term "belt scraper" is also intended to include the concept wherein paint porous regions of an endless belt also undergo a paint squeegeeing action.

Figure 8:
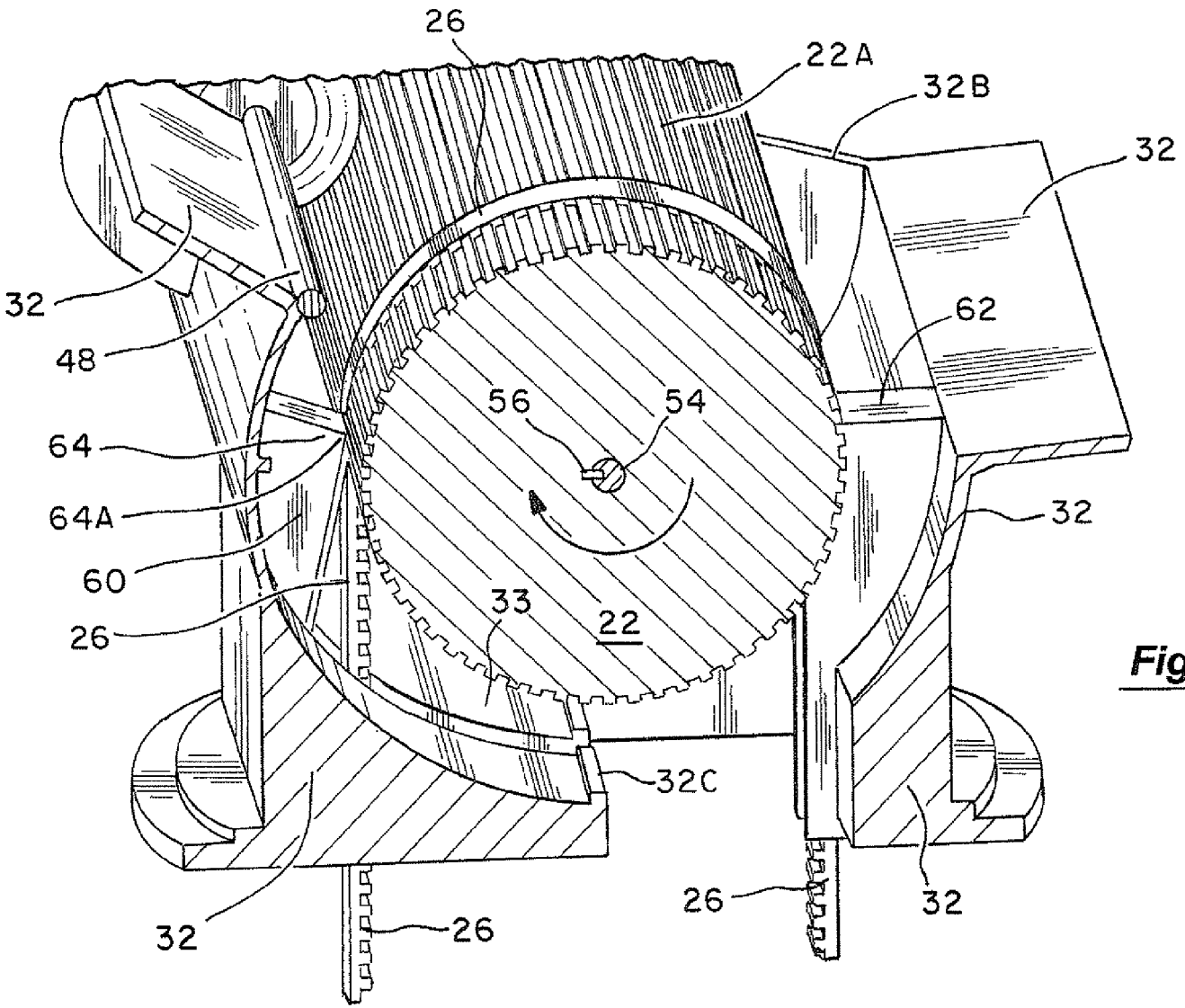
FIG. 8 is a cut-away perspective view of the housing of an electric paint tray of this patent disclosure that particularly details its paint scraping device.

FIG. 8 is a cross sectional perspective view of Applicant's electric paint tray 10 that particularly displays the location 64A where the paint scraping action takes place. This paint scraping action generally occurs in a region above the paint reservoir cavity 68 (shown in FIGS. 6 and 7) so that the scraped paint will, under the influence of gravity, flow into said cavity 68. If this paint reservoir cavity 68 is completely full of paint the scraped paint will run down the belt (in spite of its upward moving direction) and fall into the housing's lower interior cavity region 33. FIG. 8 also depicts how the paint scraper 64 serves to hold the endless belt 26 against the paint transfer drum 22. This figure also illustrates the location (on the opposite side of the paint transfer drum 22) and function of a belt holder 62 that also serves to hold endless belt 26 against the rotating paint transfer drum 22. Again, both of these belt holding actions (at belt holder 62 and at paint scraper 64) can be aided by the use of an endless belt having a chamfered belt edge and a cooperatively chamfered side of the gear array in the paint transfer drum 22 that are each illustrated in FIG. 12B.

Figure 9:
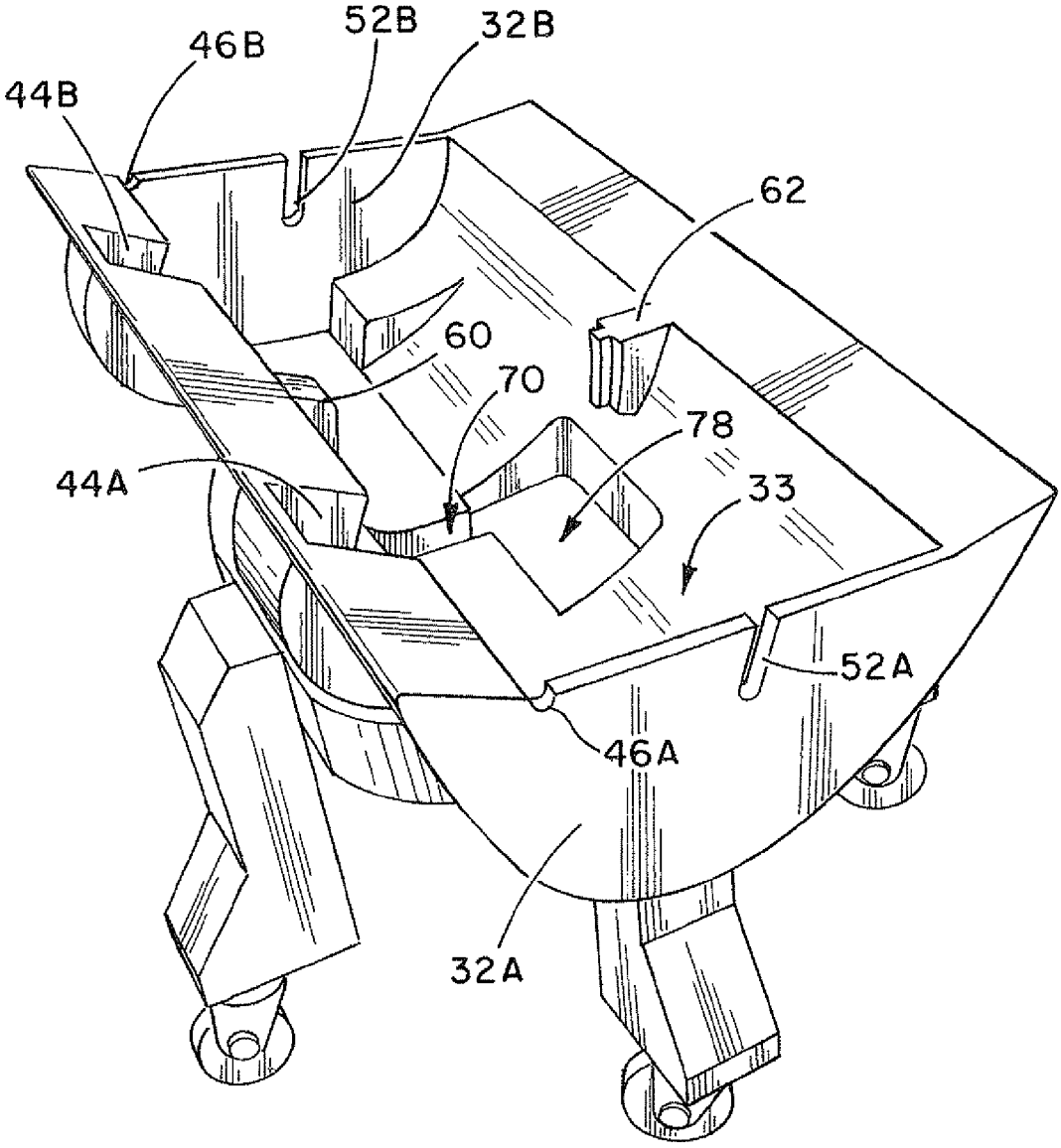
FIG. 9 is a top perspective view of the housing of Applicant's electric paint tray particularly showing a hole that allows any falling and/or excess paint in the housing's inside cavity to flow back into the paint container (e.g., a paint can) from which the endless belt obtains its paint supply.

FIG. 9 is a top perspective view of a representative housing 32 of an electric paint tray 10 of this patent disclosure. Among other things it depicts the presence of a hole 78 through which any excess paint in the lower inside cavity region 33 of the housing 32 can flow back into the container from which said paint is being withdrawn by an endless belt (not shown in this view). Again, a special rim (not seen in this FIG. 9) can be placed on the underside of the housing 32 in order to direct any falling paint into an open paint container residing under the hole 78 in the housing 32.

Figure 10:
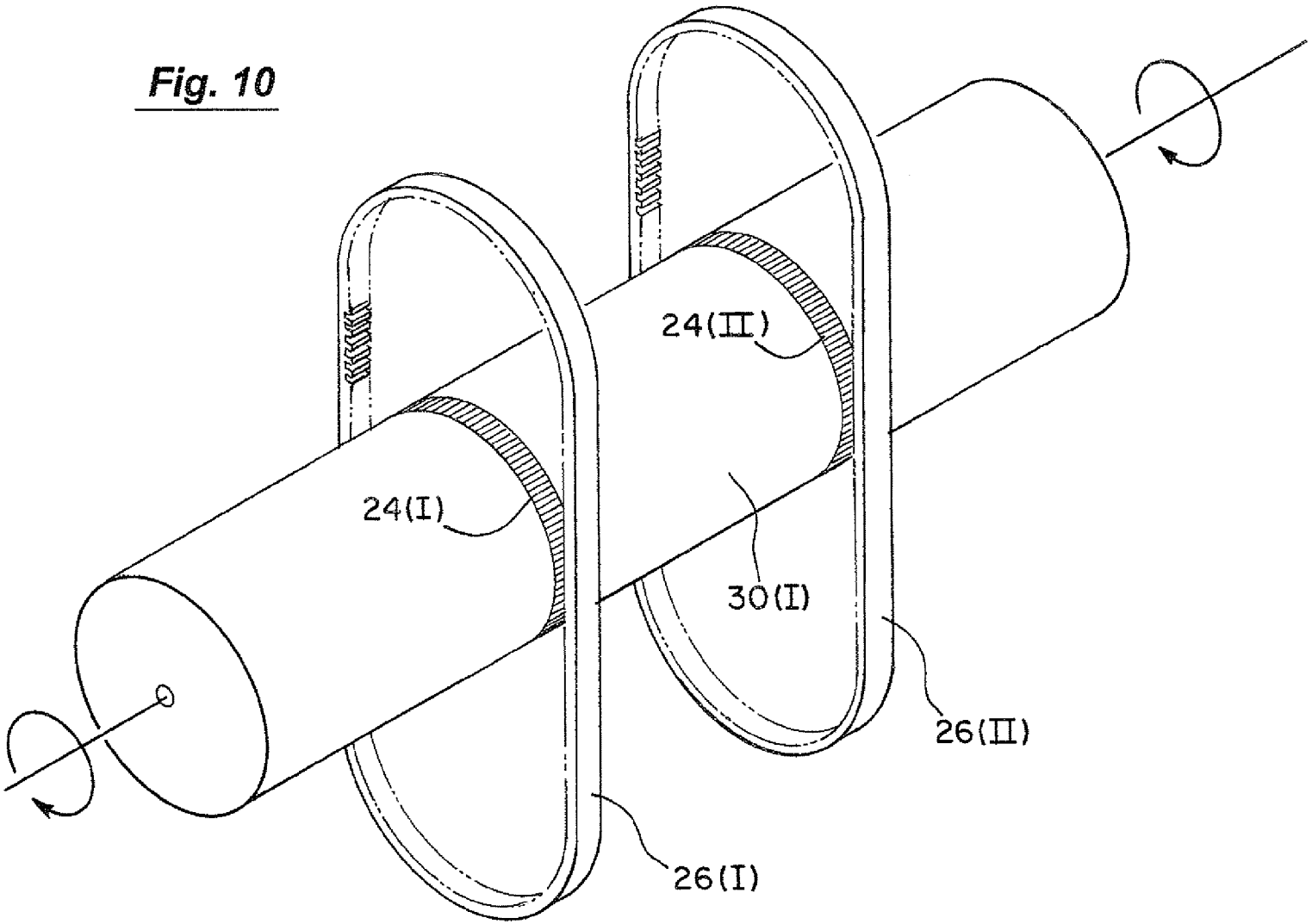
FIG. 10 is a perspective view of an alternative embodiment of Applicant's invention wherein a paint transfer drum drives multiple (in this case two) endless belts.

FIG. 10 depicts a paint transfer drum 22(I) having two gear teeth arrays 24(I) and 24(II) that can be respectively engaged with two endless belts 26(I) and 26(II) and this illustrating the concept of the use of multiple belts in the practice of this invention.

Figure 11:
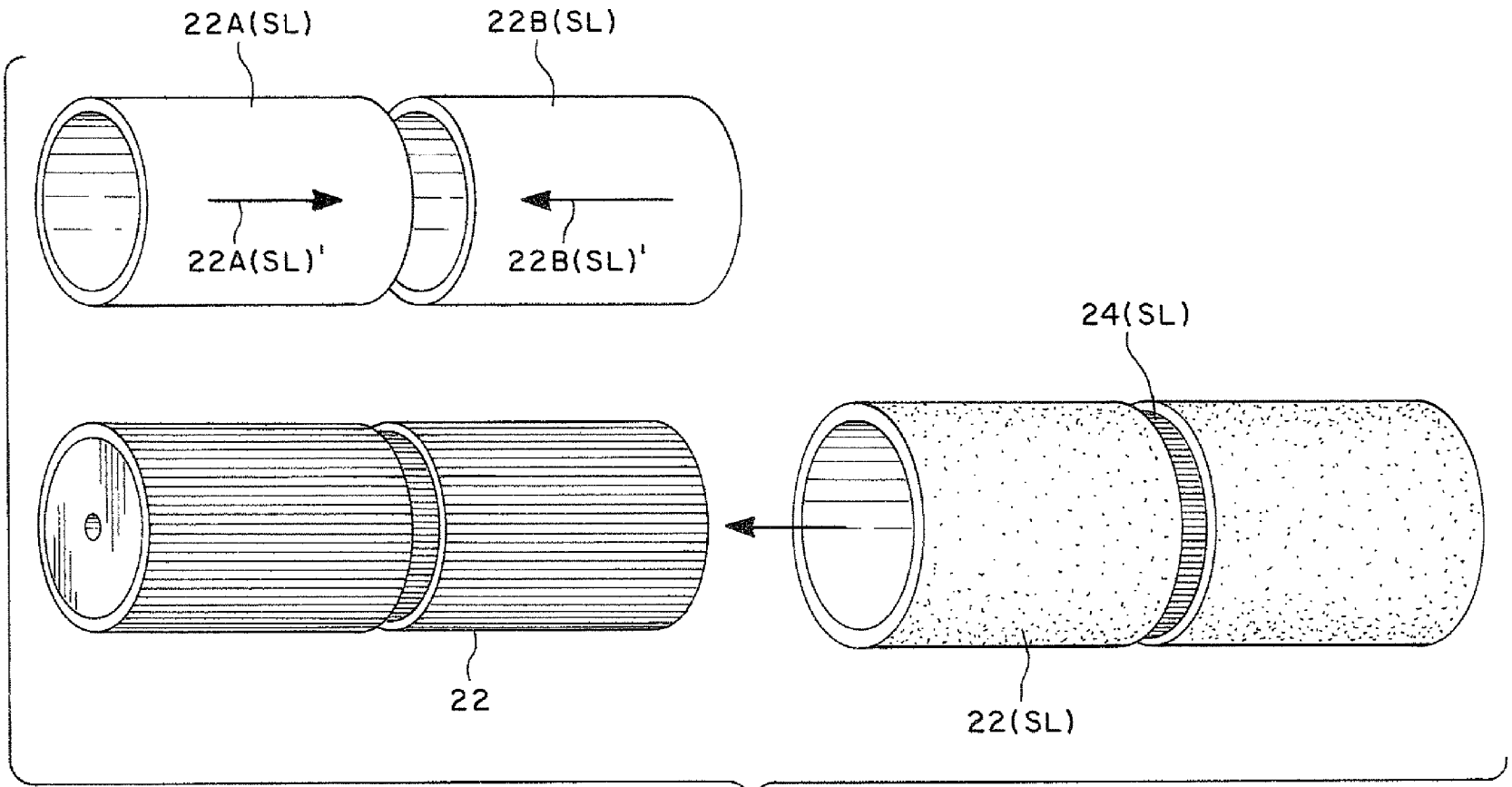
FIG. 11 is a perspective view of an alternative embodiment of this invention wherein the paint transfer drum can be covered with various replaceable sleeves.

FIG. 11 depicts a sleeve 22(SL) having a rough surface about to be placed upon a rotary powered drum 22. The sleeve 22(SL) is shown provided with its own gear teeth array 24(SL). In the alternative, a left sleeve 22A(SL) can be mounted on the left side of the paint distribution drum 22 as suggested by direction arrow 22A(SL)', while a right sleeve 22B(SL) can be mounted on the drum's right side as suggested by direction arrow 22B(SL)'. These sleeves may be considered as "throw away", replacement items.

Figure 12A:
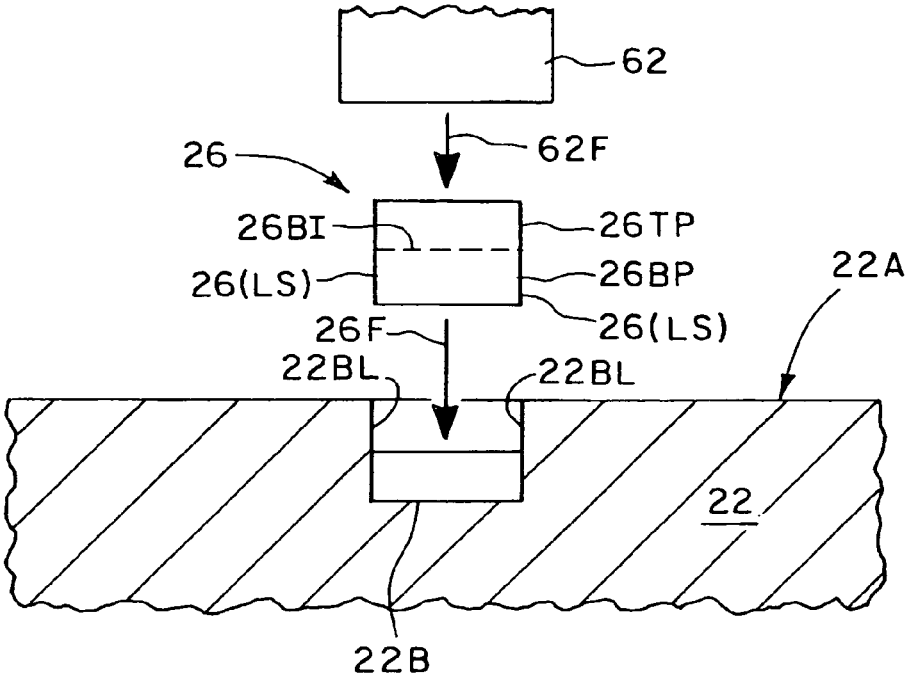
FIG. 12A shows a cross section view of an exemplary endless belt having linear sides and a cut out region in the surface of the paint transfer drum having appropriately sized linear sides in which the drum's gear teeth array is formed.

FIG. 12A is a cross sectional view of a paint transfer drum 22 whose surface 22A is shown provided with a rectangular cavity 22B (having linear walls 22BL) in which this paint transfer drum's gear teeth array 24 is formed. An endless belt 26 having linear sides 26(LS) is shown positioned above the cavity 22B in the paint transfer drum 22. Direction arrow 26F suggests that the lower regions of the endless belt 26 will fit into the cavity 22B in the paint transfer drum 22 and that the gear teeth array on the bottom part 26BP of the endless belt 26 will mechanically cooperate with the gear teeth array 24 in the paint transfer drum 22 in the manner generally suggested in FIG. 4. FIG. 12A also is intended to suggest that the endless belt 26 can have a two ply structure whose top ply 26TP is bonded to its bottom play 26BP at interface 26BI. FIG. 12A also suggests that the endless belt 26 can be held in the cavity 22B in the drum 22 by a force 62F provided by belt holder 62. In the alternative, the horizontal surface of the drum between the two vertical sides 22BL can be supplied with a knurled surface that creates friction with the bottom surface of the belt 26 and thereby drives the belt into and out of an underlying container of paint.

Figure 12B:
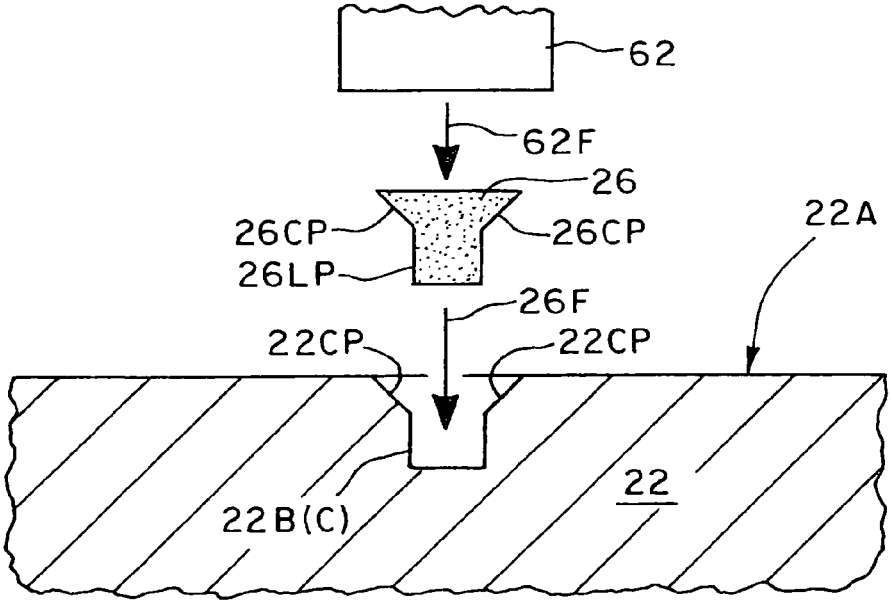
FIG. 12B shows a cross section view of another exemplary endless belt having chamfered sides and a cut out region in the surface of the paint transfer drum (having appropriately sized and angled sides) in which the drum's gear teeth array is formed.

FIG. 12B is a cross sectional view of a transfer drum 22 whose surface 22A is shown provided with a Y-shaped cavity having chamfered side portions 22CP below which the paint transfer drum's gear teeth array 24 is formed. An endless belt 26 having linear lower side portions 26LP and chamfered upper portions 26CP is shown positioned above the cavity 22B(C) in the paint transfer drum 22. Direction arrow 26F suggests that the lower regions of the chamfered endless belt 26 will fit into the cavity 22B(C) in the paint transfer drum 22 and that a gear teeth array on the lower part 26LP of the endless belt 26 will mechanically cooperate with the gear teeth array 24 in the paint transfer drum 22 in the manner generally suggested in FIG. 4. FIG. 12B also is intended to suggest that the endless belt 26 can be held in the cavity 22B(C) in the drum 22 by a force 62F provided by belt holder 62.

Figure 13:
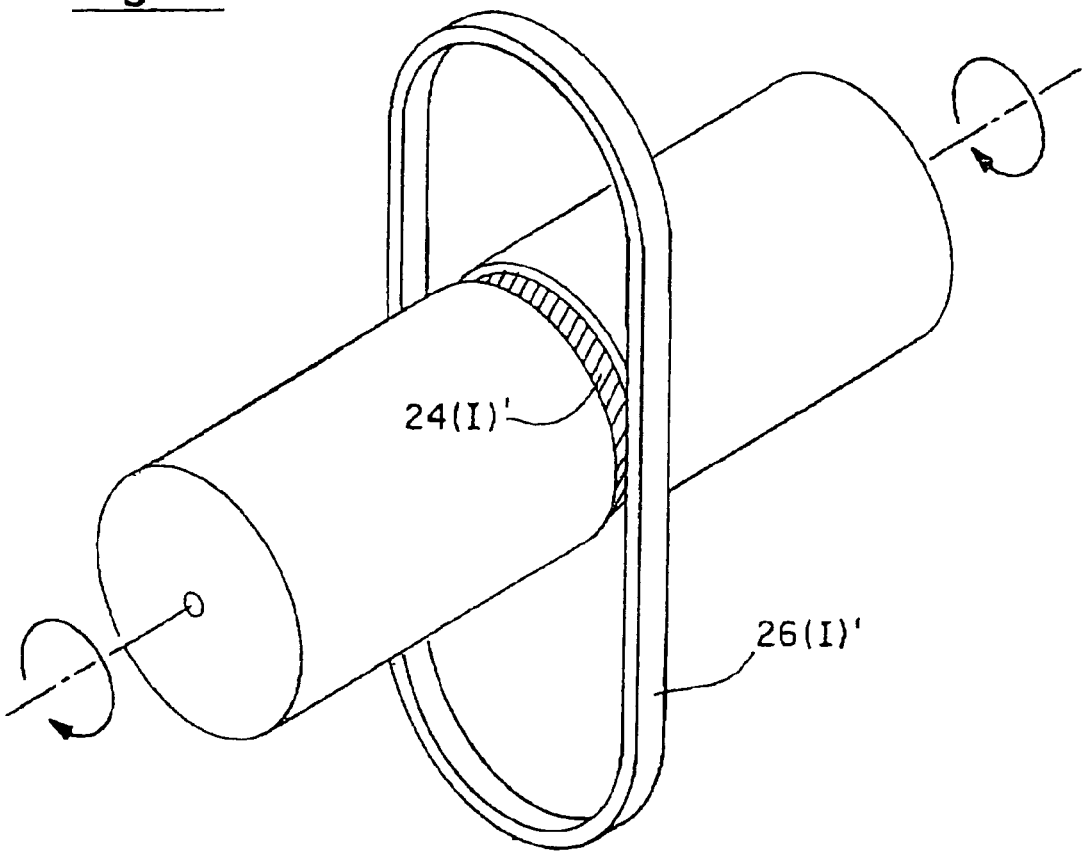
FIG. 13 is a perspective view of another embodiment of this invention wherein a paint transfer drum drives an endless belt through the friction-creating action of a knurled surface that acts upon an endless belt that does not have gear teeth.

FIG. 13 is a perspective view of an embodiment of this invention wherein Applicant's paint transfer drum drives an endless belt 26(I)' through the friction-creating action of a knurled surface 24(I)' that acts upon a gearless inside surface of said endless belt.

Those skilled in this art will appreciate that many other features can be employed in the practice of this invention; consequently the preceding patent disclosure should be regarded as illustrating, but not limiting, the scope of the following claims.

Thus having disclosed this invention, what is claimed is:

1. An apparatus adapted for raising a liquid from a container to a rotary powered drum that is capable of being rollingly contacted with an independent, liquid absorbing roller, said apparatus further comprising:

(1) an endless belt adapted to adhere the liquid and wherein said endless belt further comprises a friction-receiving interior surface that engages with a friction-creating exterior surface on a rotary powered drum and wherein said rotary powered drum (a) is journaled in a housing, (b) has an exterior surface capable of being rollingly contacted with an independent, liquid adsorbing roller and (c) has a friction-creating exterior surface that engages with the friction-receiving interior surface of the endless belt such that, when the rotary powered drum is put into powered rotation, the endless belt is adapted to be driven vertically into and out of the liquid in the container;

(2) an electric motor for powering the rotary powered drum;

(3) a scraper adapted for removing the liquid from the endless belt;

(4) a liquid distribution device adapted for receiving and laterally distributing the liquid removed from the endless belt; and (5) a housing having a journaling system adapted to place the rotary powered drum in close proximity to the liquid distribution device such that any liquid—which has fallen into the liquid distribution device—will be laterally distributed over the exterior surface of the rotary powered drum.

2. The apparatus of claim 1 wherein the friction-creating exterior surface on the rotary powered drum is a gear teeth array.

3. The apparatus of claim 1 wherein the friction-creating exterior surface on the rotary powered drum is a knurled surface.

4. The apparatus of claim 1 further comprising a pair of roller abutment devices.

5. The apparatus of claim 1 wherein the housing has a hole in its bottom region for returning excess liquid to the container over which said housing is positioned.

6. The apparatus of claim 1 wherein the liquid distribution device is an integral part of the housing.

7. The apparatus of claim 1 wherein the liquid distribution device is a distinct component that can be attached to the housing.

8. The apparatus of claim 1 wherein the rotary powered drum is provided with a replaceable sleeve having a liquid absorbing and desorbing surface material.

9. The apparatus of claim 1 further comprising a base whose underside is provided with a wheel system.

10. The apparatus of claim 1 further comprising three or more legs that support the housing.

11. The apparatus of claim 1 wherein the endless belt is made of a material capable of readily absorbing and desorbing a select liquid.

12. The apparatus of claim 1 wherein the housing has a lower rim that is capable of fitting into an open top of a liquid container and wherein a lower region of the housing has a hole so that excess liquid will, under the influence of gravity, fall back into the container.

13. The apparatus of claim 1 wherein multiple endless belts are respectively employed in conjunction with multiple gear teeth arrays on the exterior surface of the rotary powered drum.

14. The apparatus of claim 1 wherein the endless belt has a multi-ply structure.

15. The apparatus of claim 1 wherein the endless belt has a chamfered portion.

16. An electric paint tray adapted for raising a liquid paint from a paint container to an elongated, rotary powered paint transfer drum that is capable of being rollingly contacted with an independent, paint absorbing roller, said electric paint tray further comprising:

(1) an endless belt adapted to adhere the liquid paint and wherein said endless belt further comprises a friction-receiving interior surface that engages with a friction-creating exterior surface on an elongated, rotary powered paint transfer drum and wherein said elongated, rotary powered paint transfer drum (a) is journaled in a housing, (b) has an exterior surface capable of being rollingly contacted with an independent, paint absorbing roller and (c) has a friction-creating exterior surface that engages with the friction-receiving interior surface of the endless belt such that, when the elongated, rotary powered paint transfer drum is put into powered rotation, the endless belt is adapted to be driven vertically into and out of the liquid paint in the paint container;

(2) an electric motor for powering the rotary powered paint transfer drum;

(3) a scraper adapted for removing the liquid paint from the endless belt;

(4) a paint distribution device for receiving and laterally distributing the liquid paint removed from the endless belt; and (5) a housing having a journaling system adapted to place the elongated, rotary powered paint transfer drum in close proximity to the paint distribution device such that any liquid paint—which has fallen into the paint distribution device—will be laterally distributed over the exterior surface of the elongated, rotary powered paint transfer drum.

17. The electric paint tray of claim 16 wherein the friction-creating exterior surface on the rotary powered drum is a gear teeth array.

18. The electric paint tray of claim 16 wherein the friction-creating exterior surface on the rotary powered drum is a knurled surface.

19. The electric paint tray of claim 16 further comprising a pair of rotatable roller abutment devices.

20. The electric paint tray of claim 16 wherein the housing has a hole in its bottom region for returning excess liquid paint to the paint container over which the housing is positioned.

21. The electric paint tray of claim 16 wherein the liquid distribution device is an integral part of the housing.

22. The electric paint tray of claim 16 wherein the liquid distribution device is a distinct component that can be attached to the housing.

23. The electric paint tray of claim 16 wherein the rotary powered paint transfer drum is provided with a replaceable sleeve having a paint absorbing and desorbing surface material.

24. The electric paint tray of claim 16 further comprising a base whose underside is provided with a wheel system.

25. The electric paint tray of claim 16 further comprising three or more legs that support the housing.

26. The electric paint tray of claim 16 wherein the endless belt is made of a material capable of readily absorbing and desorbing a select liquid paint.

27. The electric paint tray of claim 16 wherein the endless belt is made in a two ply structure.

28. The electric paint tray of claim 16 wherein the housing has a lower portion that is capable of fitting into an open top of the paint container wherein a lower portion of the housing has a hole so that excess liquid paint will, under the influence of gravity, fall back into said paint container located under the hole in the housing.

29. An electric paint tray adapted for raising a water-based latex paint from a paint container to an elongated, rotary powered paint transfer drum that is capable of being rollingly contacted with an independent, paint absorbing roller, said electric paint tray further comprising:

(1) a chamfered endless belt adapted to absorbing and desorbing the water-based latex paint and having an inside surface provided with a first gear teeth array that cooperatively engages with a second, chamfer-sided, gear teeth array on an elongated, rotary powered paint transfer drum and wherein said elongated, rotary powered paint transfer drum (a) is journaled in a housing, (b) has a paint distribution surface capable of being rollingly contacted with an independent, paint absorbing roller and (c) has a second gear teeth array having a chamfer sided portion on its exterior surface that cooperatively engages with the first gear teeth array on the inside surface of the chamfered endless belt such that, when the elongated, rotary powered paint transfer drum is put into powered rotation, the chamfered endless belt is adapted to be driven vertically into and out of the water-based latex paint in the paint container;

(2) a belt holder for holding the chamfered endless belt in the chamfer-sided gear teeth array of the paint transfer drum;

(3) an electric motor for powering the rotary powered paint transfer drum;

(4) a scraper adapted for removing the water-based latex paint from the chamfered endless belt;

(5) a paint distribution device adapted for receiving and laterally distributing water-based latex paint removed from the chamfered endless belt;

(6) a housing having a journaling system adapted to place the elongated, rotary powered paint transfer drum in close proximity to the paint distribution device such that any water-based latex paint—which has fallen into the paint distribution device—will be laterally distributed over the exterior surface of the elongated, rotary powered paint transfer drum; and (7) a pair of rotatable roller abutment devices.

30. A method for raising a liquid from a container to a rotary powered drum that is capable of being rollingly contacted with an independent, liquid absorbing roller, said method further comprising:

(1) looping an endless belt having a friction-receiving interior surface over a friction-creating exterior portion of the rotary powered drum;

(2) rotatively powering said drum such that the endless belt is driven vertically into and out of the liquid in the container;

(3) scraping the liquid from the endless belt; and (4) laterally distributing the liquid removed from the endless belt over the exterior surface of the rotary powered drum.

* * * * *